US007987829B2

(12) United States Patent
Dupuis et al.

(10) Patent No.: US 7,987,829 B2
(45) Date of Patent: Aug. 2, 2011

(54) CAMSHAFT ADJUSTING DEVICE

(75) Inventors: Craig Dupuis, Windsor (CA); Inhwa Chung, Lasalle (CA)

(73) Assignee: Schaeffler KG, Herzogenaurach (DE)

( * ) Notice: Subject to any disclaimer, the term of this patent is extended or adjusted under 35 U.S.C. 154(b) by 340 days.

(21) Appl. No.: 12/361,791

(22) Filed: Jan. 29, 2009

(65) Prior Publication Data

US 2009/0188456 A1 Jul. 30, 2009

Related U.S. Application Data

(60) Provisional application No. 61/024,803, filed on Jan. 30, 2008.

(51) Int. Cl.
*F01L 1/34* (2006.01)

(52) U.S. Cl. ..... 123/90.17; 123/90.15; 123/90.31

(58) Field of Classification Search ..... 123/90.15, 123/90.17, 90.31
See application file for complete search history.

(56) References Cited

U.S. PATENT DOCUMENTS 6,155,219 A * 12/2000 Fukuhara et al. ..... 123/90.17
2005/0115526 A1* 6/2005 Schneider ..... 123/90.17

* cited by examiner

*Primary Examiner* — Zelalem Eshete
(74) *Attorney, Agent, or Firm* — Lucas & Mercanti, LLP

(57) ABSTRACT

The camshaft adjusting device has an inner spring retainer which mates with a rotor and an outer spring retainer which is fixed on a spring cover plate.

8 Claims, 3 Drawing Sheets

CAMSHAFT ADJUSTING DEVICE

FIELD OF THE INVENTION

This Invention relates to camshaft adjusting devices and, more specifically, to vane-type camshaft adjusting devices which change the angular relationship between a camshaft and an internal combustion engine crankshaft using a stator and a rotor wherein the rotor is housed within the stator and a pressure medium is used to adjust the relative angular position of the rotor and the stator.

BACKGROUND OF THE INVENTION

Vane-type cam adjustors, sometimes referred to as phasers or actuators, are used conventionally to adjust the angular relationship between the camshaft and the internal combustion engine crankshaft. Such devices have a rotor housed within a stator and the rotor has vanes which radially extend into pressure chambers of the stator and divide the pressure chambers. A pressure medium is pumped onto one of the sides of the pressure chamber in order to shift the rotor relative to the stator. This shifting provides for an angular adjustment of the camshaft with respect to the crankshaft and adjustment of the timing for opening and closing of various valves which are affected by the camshaft.

In order to change the resultant sum of the moments acting on the device, springs are sometimes used. Coil springs, which are often used, are mounted in the center of the rotor, one end of the spring is fixed to the rotor and the other end of the spring is fixed to a cover of the stator by pins, bolts or a casting feature. Coil springs are not capable of withstanding a large number of load cycles with a high pre-torque. Coil springs also are difficult to use in engines with high camshaft friction.

Another type of spring that has been employed are flat, spiral torsion springs. Typically, these spiral torsion springs were fixed to the rotor and the stator by means of pins or screws. In some cases, it can be difficult to package these pins or screws. Thus, there is a need for alternative spring retainers for use with spiral torsion springs.

OBJECT OF THE INVENTION

The object of the Invention is to devise new spring retainers for camshaft adjusting devices which employ torsion springs. It is further the objective of the Invention to simplify the spring retainers in vane-type camshaft adjustors.

These and other objects of the Invention will be more readily understood by reference to the following description.

SUMMARY OF THE INVENTION

The objects of the Invention are obtained by using outer spring retainer fixed to an inner wall of a spring cover plate which is spaced apart and fixed to a cover plate of the stator. The objects of this Invention are further obtained by using an inner spring retainer having a shoulder that mates with a retaining cavity in the rotor so as to fix the rotor to the inner spring retainer. These arrangements eliminate the pins and bolts that were typically used for fixing one end of the spring to the rotor and provides an efficient attachment for the torsion spring in a camshaft adjusting device.

Broadly, the Invention can be defined as a camshaft adjusting device for changing an angular relationship between a camshaft and an internal combustion engine crankshaft comprising:

a stator and a rotor housed within and adjustable in a circumferential direction relative to the stator by pressure medium, the rotor connectable to a camshaft and the stator connectable to a crankshaft;

a first cover plate and a second cover plate between which the stator and rotor are housed, the first cover and the second cover fixed to the stator;

a spring cover plate spaced axially apart and fixed to the first cover plate;

an outer spring retainer positioned between the spring cover plate and the first cover plate, the outer spring retainer fixed to the spring cover plate; and a torsion spring positioned between the spring cover plate and the first cover plate, the torsion spring having an inner spring end connected to the rotor and an outer spring end engaged with the outer spring retainer thereby connecting the outer spring end to the spring cover plate, the torsion spring configured to rotate the rotor relative to the stator such that the torsion spring is rotatably fixed to the rotor.

Preferably, an inner spring retainer is positioned between the spring cover plate and the first cover plate, the inner spring retainer fixed to the rotor;

wherein the inner spring end of the torsion spring engages the inner spring retainer thereby connecting the inner spring end to the rotor.

Preferably, the outer spring retainer is positioned and fixed at an outwardly radial position on an inner wall of the spring retaining cover and the inner spring retainer is positioned at an inwardly radial position and fixed to the rotor by a radial shoulder that extends through the first cover and fixably engages a retaining cavity in the rotor.

Preferably, the outer spring retainer comprises one or more radially oriented posts fixed at an outer radial position on an inner wall of the spring cover plate.

Preferably, the inner spring retainer has a shoulder that is cylindrical and axially oriented with one or more radially oriented projections that mate with one or more radially oriented indents on the retaining cavity of the rotor. Preferably, the number of indents equals the number of projections.

Preferably, the retaining cavity on the rotor is axially oriented in an outer sidewall of the rotor and opens towards the first cover plate. The first cover plate, in turn, has an opening commensurate in size with the radial size of the retaining cavity and the inner spring retainer has a radial shoulder that extends through the opening into the first cover and fixably engages the retaining cavity. In order for the shoulder of the inner spring retainer to engage the retaining cavity, the radial projections on the shoulder engage the radial indents on the retaining cavity.

Preferably, the spring cover has radial spacers in order to space the spring cover plate away from the first cover plate. These radial spacers also preferably provide a channel through which fasteners extend for connecting the spring cover plate to the rest of the device.

BRIEF DESCRIPTION OF THE DRAWINGS

These and other aspects of the Invention may be more readily understood by reference to one or more of the following drawings.

DETAILED DESCRIPTION OF THE DRAWINGS

Figure 1:
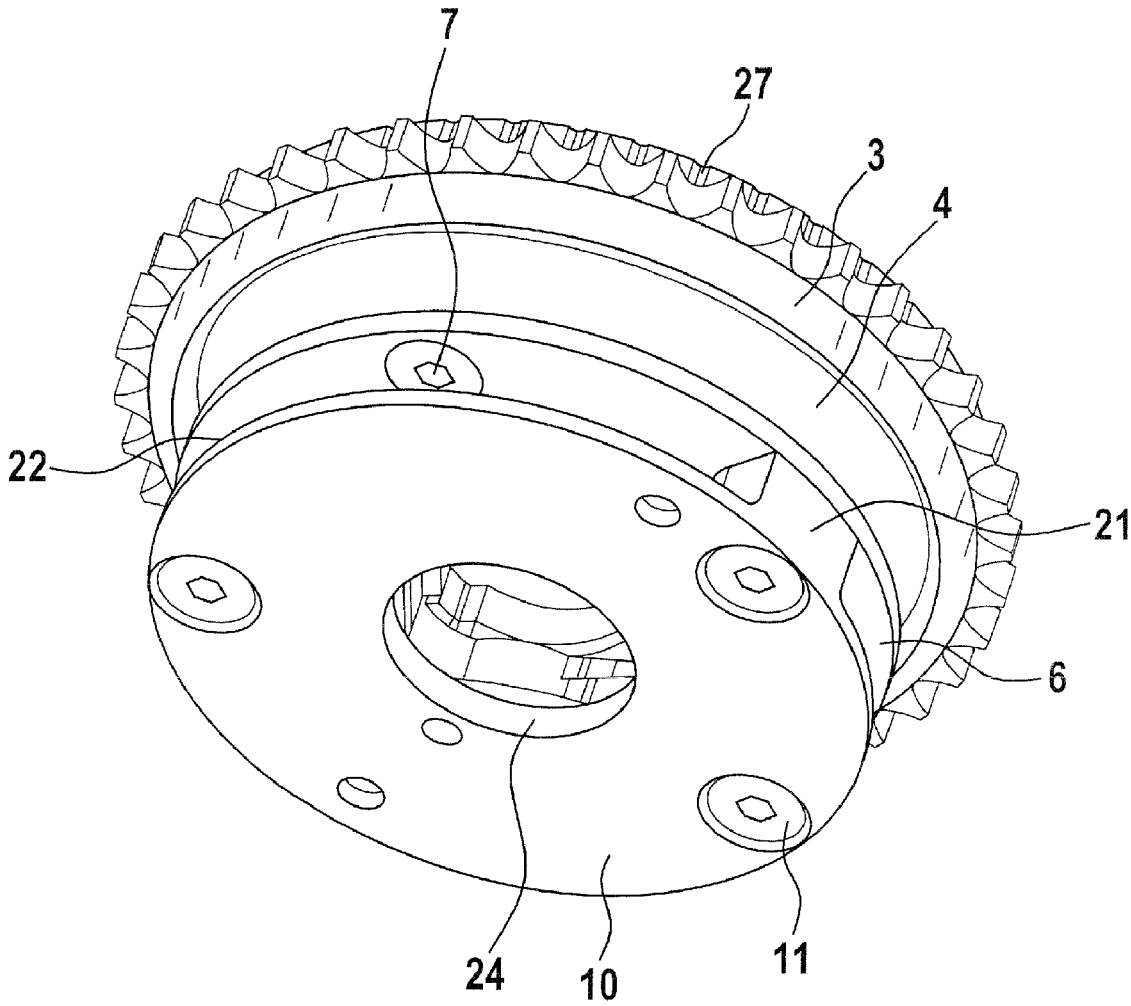
FIG. 1 is an outside view of the device of the Invention.
Figure 2:
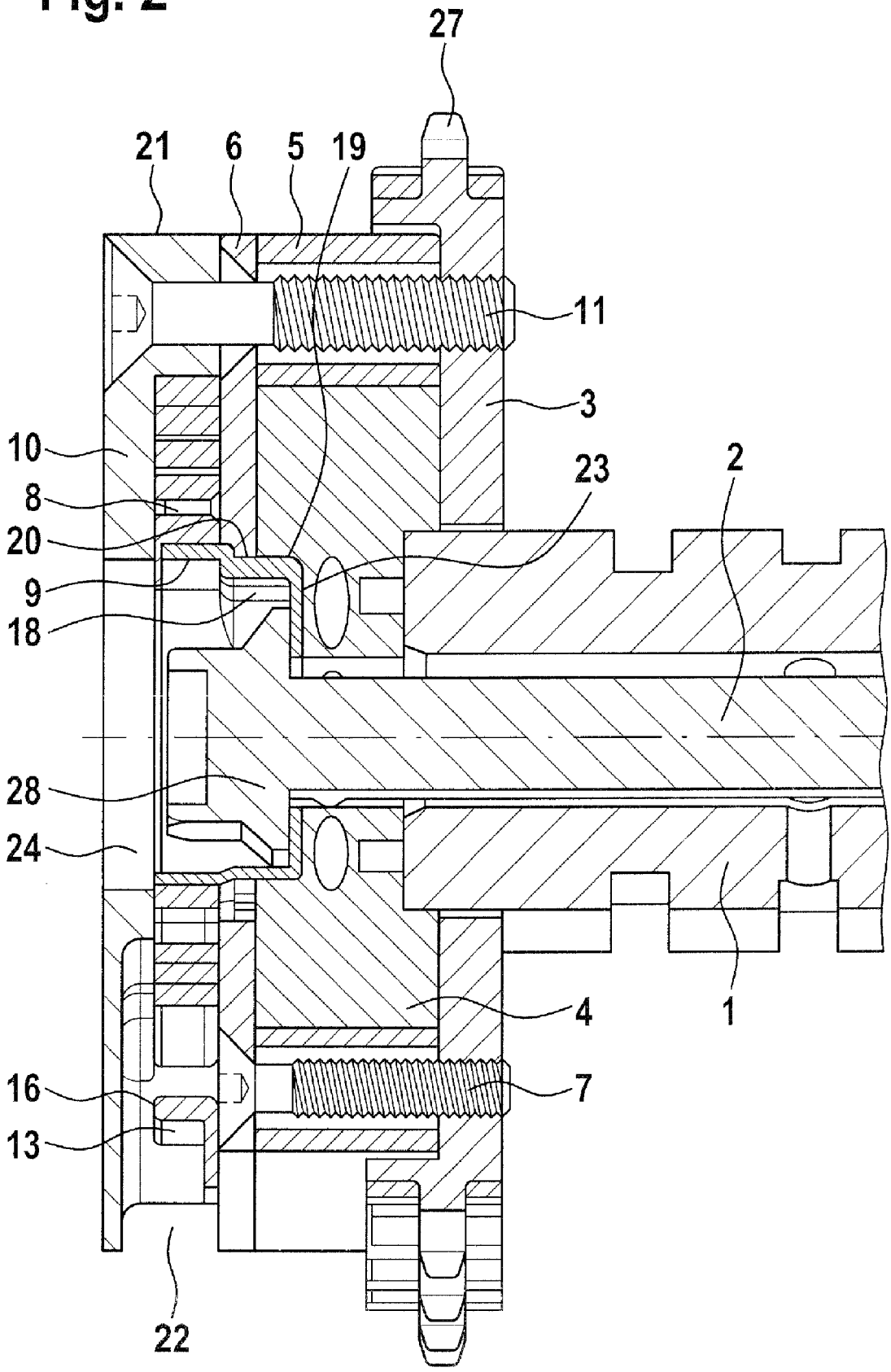
FIG. 2 is a cross section of the device of the Invention.

Referring to FIGS. 1 and 2, the device of the Invention is fixed to camshaft 1 by fastening bolt 2 to camshaft 1. Bolt 2 passes through second cover plate 3, rotor 4, first cover plate 6, inner spring retainer 9, and spring cover plate 10.

Sprocket 27 connects the device to an engines crankshaft in a conventional manner. Sprocket 27 is part of second cover plate 3. As will be understood, the sprocket can be attached to any part of the housing to include the spring cover, the first or second cover plate or stator. Also there can be multiple sprockets.

Stator 5 and first cover plate 6 are bolted to second cover plate 3 by bolts 7. Rotor 4 is allowed to partially rotate within the pressure chambers that are defined by stator 5 and first cover plate 6 and second cover plate 3. It is this partial rotation that allows for the angular change in the relationship between camshaft 1 and the crankshaft. Pressure medium is conveyed in a conventional manner to the pressure chambers of stator 5 in order to affect the angular shift of rotor 4 in relation to stator 5.

Torsion spring 8 is used to change the resulting sum of the moment acting on the device. Torsion spring 8 is mounted around inner spring retainer 9 and is positioned between spring cover plate 10 and first cover plate 6. Spring retainer 9 is positioned axially between spring cover plate 10 and first cover plate 6. Spring retainer 9 is fixed to rotor 4. Bolts 11 are used to fix spring cover plate 10 to first cover plate 6, stator 5 and second cover plate 3.

Outer spring retainer 12 is illustrated as comprising first post 13 and second post 14. First post 13 and second post 14 are radially oriented posts that are fixed to first cover plate 6.

Figure 3:
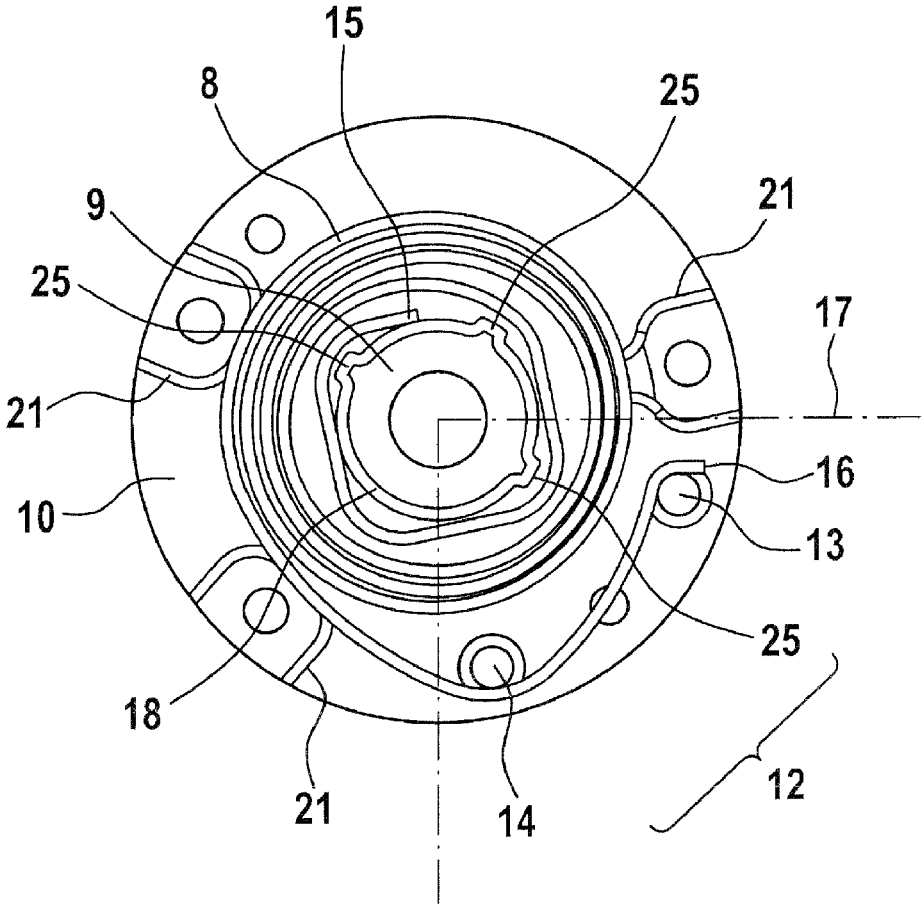
FIG. 3 illustrates the inner and outer spring retainers.
Figure 4:
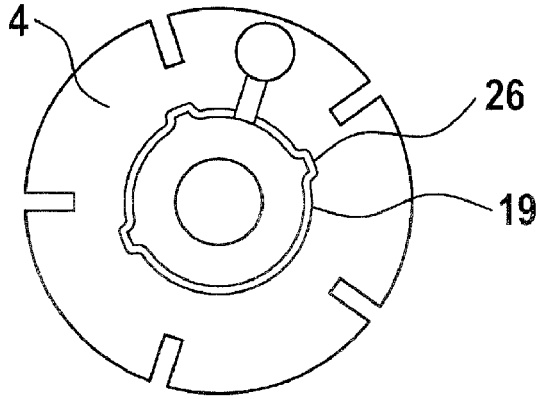
FIG. 4 illustrates the rotor retaining cavity.

Torsion spring 8 has inner spring end 15 and outer spring end 16. Inner spring end 15 engages inner spring retainer 9. Outer spring end 16 engages rotor spring retainer 12 as illustrated in FIG. 3.

Inner spring retainer 9 has shoulder 18 which extends axially out from inner retainer 9 and forms a cylindrical shoulder which mates with rotor retaining cavity 19. Radial lip 23 which extends from a distal end of shoulder 18 also mates with a portion of rotor retaining cavity 19 as illustrated in FIG. 2. In order to lock inner spring retainer 9 to rotor 4, shoulder 18 has radial projections 25 that mate with radial indents 26 of rotor retaining cavity 19.

First cover plate 6 has opening 20 which allows for shoulder 18 to pass through first cover plate 6.

Spacers 21 are fixed to spring cover plate 10 on an inside wall and provide the axial spacing to provide a spring gap 22 between first cover plate 6 and spring cover plate 10.

Opening 24 in spring cover plate 10 allows bolt 2 to pass through spring cover plate 10 for affixing the device to camshaft 1. Bolt 2 presses against radial lip 23 so as to tightly fix inner spring retainer 9 to rotor 4 in an axial direction.

Preferably, torsion spring 8 is a flat spiral torsion spring as illustrated. Preferably, spring cover plate 10 is fixed by bolts 11 to first cover plate 6, stator 5 and second cover plate 3.

REFERENCE CHARACTERS

1. Camshaft
2. Axial central bolt
3. Second cover plate
4. Rotor
5. Stator
6. First cover plate
7. Bolt
8. Torsion spring
9. Inner spring retainer
10. Spring cover plate
11. Bolt
12. Outer spring retainer
13. First post
14. Second post
15. Inner spring end
16. Outer spring end
18. Shoulder
19. Rotor retaining cavity
20. Opening, front cover
21. Spacers
22. Spring gap
23. Radial lip
24. Opening, spring cover plate
25. Radial projection
26. Radial indents
27. Sprocket

What we claim is:

1. A camshaft adjusting device for changing an angular relationship between a camshaft and an internal combustion engine crankshaft, comprising:

a stator and a rotor housed within and adjustable in a circumferential direction relative to the stator by a pressure medium, the rotor connectable to a camshaft and the stator connectable to the crankshaft;

a first cover plate and a second cover plate between which the stator and rotor are housed, the first cover and the second cover fixed to the stator;

a spring cover plate spaced axially apart and fixed to the first cover plate;

an outer spring retainer positioned between the spring cover plate and the first cover plate, the outer spring retainer fixed to the spring cover plate; and a torsion spring positioned between the spring cover plate and the first cover plate, the torsion spring having an inner spring end connected to the rotor and an outer spring end engaged with the outer spring retainer thereby connecting the outer spring end to the spring cover plate, the torsion spring configured to rotate the rotor relative to the stator such that the torsion spring is rotatably fixed to the rotor; and an inner spring retainer positioned between the spring cover plate and the first cover plate and fixed to the rotor, wherein the inner spring end of the torsion spring engages the inner spring retainer thereby connecting the inner spring end to the rotor, and wherein the outer spring retainer is positioned and fixed at an outwardly radial position on an inner wall of the spring cover plate; and the inner spring retainer is positioned at an inwardly radial position and fixed to the rotor by a radial shoulder that extends through the first cover and fixably engages a retaining cavity in the rotor.

2. The device of claim 1, wherein the torsion spring is a flat spiral torsion spring.

3. The device of claim 1, wherein the outer spring retainer is one or more radially oriented posts fixed at an outer radial position on the spring cover plate.

4. The device of claim 1, wherein the rotor has a retaining cavity which opens towards the first cover plate; the first cover plate has an opening commensurate in radial size to the retaining cavity; and the inner spring retainer has a radial shoulder that extends through the opening in the first cover and fixably engages the retaining cavity.

5. The device of claim 1, wherein the spring cover plate is fixed to the first cover plate, the stator and the second cover plate by fasteners that extend therethrough.

6. The device of claim 1, wherein the spring cover plate has spacers fixed to an inside wall of the spring cover and through which fasteners extend to fix the spring cover plate to the first cover plate.

7. The device of claim 1, wherein the axial space between the spring cover plate and the first cover plate is a spring gap.

8. The device of claim 1, wherein an axial, central bolt connects the device to the camshaft, the axial central bolt axially press the inner spring retainer against the rotor, the second cover plate having an opening for accommodating the camshaft and allowing the axial bolt to pass through and fix the device on the camshaft and allowing the camshaft to contact the rotor, the spring cover plate having an axial central opening to allow the bolt to pass through and contact the inner spring retainer.

* * * * *